United States Patent [19]

Russell, III

[11] 4,130,203

[45] Dec. 19, 1978

[54] RECORD TRAY WITH ADJUSTABLE SIDE RAILS

[76] Inventor: Thomas H. Russell, III, 14 Sulgrave Rd., West Hartford, Conn. 06107

[21] Appl. No.: 842,941

[22] Filed: Oct. 17, 1977

[51] Int. Cl.[2] ..... A47F 7/00

[52] U.S. Cl. ..... 211/51; 211/126; 220/8

[58] Field of Search ..... 211/10, 11, 50, 51, 211/126, 184, 45, 162; 220/8, 23.4, DIG. 25; 40/102

[56] References Cited

U.S. PATENT DOCUMENTS

| | | | |
|---|---|---|---|
| 1,271,508 | 7/1918 | Hall | 211/51 |
| 1,894,597 | 1/1933 | Murray | 211/51 |
| 2,360,709 | 10/1944 | Nahbolz | 211/51 |
| 2,369,728 | 2/1945 | Farkas | 220/8 |
| 2,475,961 | 7/1949 | Hilbert | 220/8 |
| 2,620,082 | 12/1952 | Harmon | 220/8 |
| 2,625,162 | 1/1953 | Edeborg | 211/51 |
| 3,900,157 | 8/1975 | Roth | 211/126X |

FOREIGN PATENT DOCUMENTS

| | | | |
|---|---|---|---|
| 854714 | 4/1940 | France | 211/51 |

*Primary Examiner*—James T. McCall
*Assistant Examiner*—Terrell P. Lewis
*Attorney, Agent, or Firm*—McCormick, Paulding & Huber

[57] ABSTRACT

A posting tray, or similar record holding tray, includes two side rails which are adjustably movable toward and away from one another, and are releasably fixable in any given position of adjustment, to suit the tray for record cards of various different widths. Each side rail is part of a C-shaped member having two laterally inwardly extending legs at its opposite ends. The legs are connected to the front and rear walls of the tray. The two legs associated with each wall overlap one another throughout a portion of the range of adjustable movement of the side rails, and are out of such overlapping relationship throughout another portion of the range of adjustable movement, to maximize the side rail spacing variation range. The overlap of the legs which does occur may be accommodated in either the vertical plane or the horizontal plane.

5 Claims, 7 Drawing Figures

FIG. 3
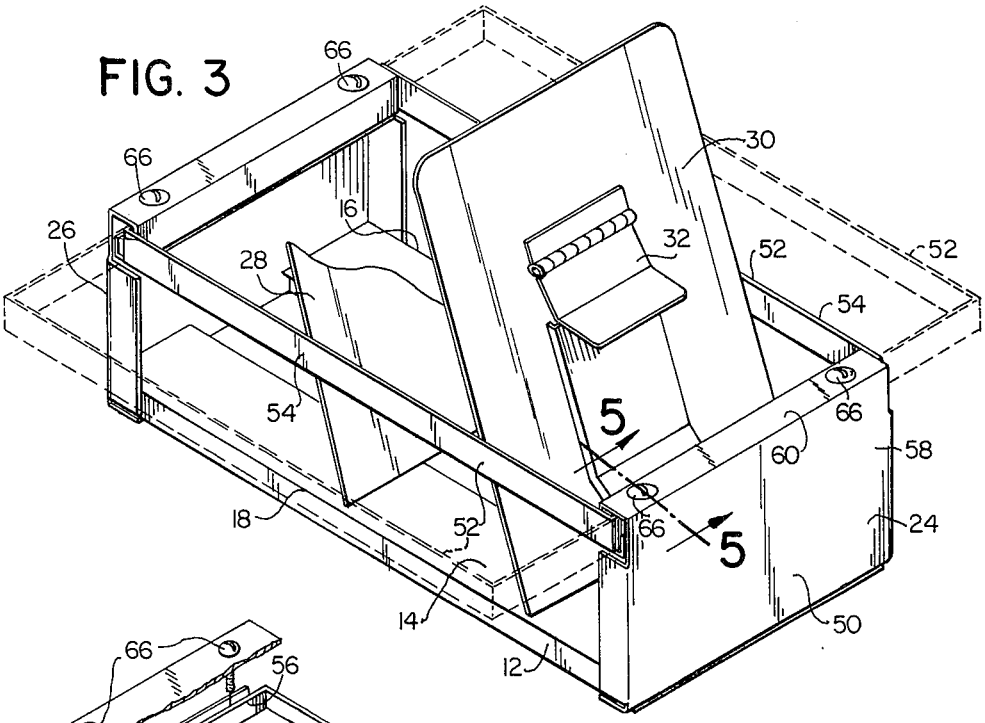
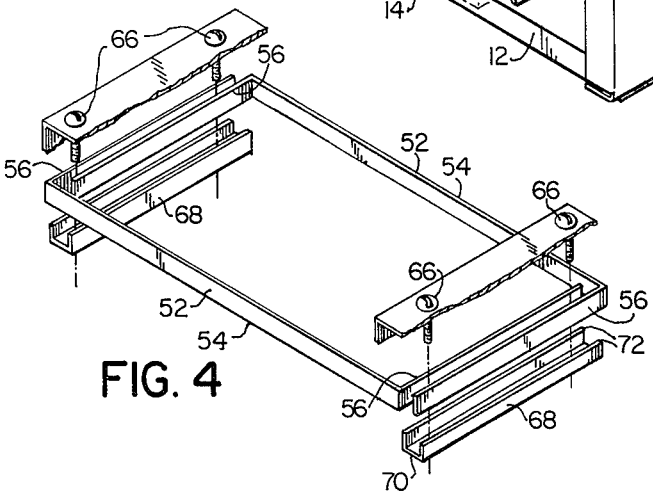
FIG. 4
FIG. 5
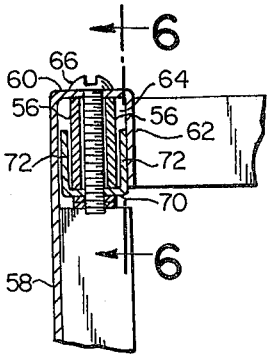
FIG. 6
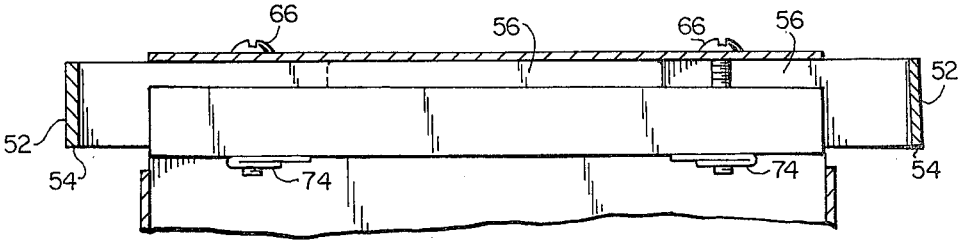

RECORD TRAY WITH ADJUSTABLE SIDE RAILS

BACKGROUND OF THE INVENTION

This invention relates to trays, such as posting trays, for holding a collection of generally rectangular record cards in a face-to-face arrangement with their faces generally vertical, and deals more particularly with such a tray including adjustable side rails adapting the tray for use with record cards of various different widths.

In many bookkeeping systems it is customary to store a collection of ledger sheets, statements, or other record cards in a tray which holds a group of such cards in a face-to-face arrangement with their faces generally vertical and which allows the group of cards to be spread at the location of any individual card to provide easy access to that card for the posting or retrieval of information to or from it. In any given bookkeeping system the record cards are generally of a uniform size, but the size of the cards may vary from one system to another. Therefore, to accommodate the cards of different systems, different size posting trays are required.

To overcome the need for different posting trays for differently sized record cards, it has been proposed in the past to provide a posting tray with adjustable side rails or walls which are movable toward and away from one another to suit the tray to different widths of cards. Trays with such adjustable side members are shown, for example, by prior U.S. Pat. Nos. 2,128,882, 2,520,738 and 2,625,162. These prior trays, however, have been deficient in several respects. The general object of this invention is, therefore, to provide a posting tray having adjustable side rails, which is an improvement over prior trays with adjustable side rails, and which, in particular, provides a very simple, effective and easily manipulated mechanism for fixing the side rail members to the remainder of the tray in any selected position of adjustment.

SUMMARY OF THE INVENTION

The invention resides in a tray, such as a posting tray or the like, for holding a collection of generally rectangular record cards in a face-to-face arrangement with their faces generally vertical. A base provides a horizontal upwardly facing rectangular supporting surface having front and rear ends and two side edges. Front and rear walls extend upwardly from the front and rear ends of the base, respectively, and two side rail members, at opposite sides of the base and spaced vertically from the supporting surface, extend longitudinally of the base between the front and rear walls. Each side rail member is of a C-shape, having a side rail portion and two inwardly extending horizontal legs at opposite ends of the side rail portion. The two front legs of the rail members overlap the front wall and the rear wall, and each wall carries a connecting and clamping means for connecting the adjacent two legs to the wall so that the legs may be adjustably moved in opposite directions laterally of the base to vary the spacing between the side rail portions and for releasably clamping the legs in any selected position of adjustment. The legs are of such length, preferably approximately equal to the width of the front and rear walls, that the two associated with each wall overlap one another throughout part of their range of movement. Throughout another part of their range of movement the two legs of each wall are out of overlapping relationship. In one embodiment of the invention, the overlapping of the legs is in the vertical plane; in another embodiment it is in the horizontal plane. In either event, the overlapping of the legs enables a wide variation in the spacing of the side rail members thereby enabling the tray to be used with a wide range of different record card sizes.

BRIEF DESCRIPTION OF THE DRAWINGS

FIG. 3 is a perspective view of a tray comprising another embodiment of this invention, the solid lines showing the side rail members in their position of minimum spacing and the broken lines showing the side rail members in their position of maximum spacing, part of the rear follower plate being shown in phantom.

FIG. 4 is an exploded perspective view of a portion of the tray of FIG. 3 showing more clearly the construction of the side rail members and of the means for connecting them to the front and rear walls.

FIG. 5 is a fragmentary sectional view taken on the line 5—5 of FIG. 3.

FIG. 6 is a transverse sectional view taken on the line 6—6 of FIG. 5.

DETAILED DESCRIPTION OF THE PREFERRED EMBODIMENTS

Figure 1:
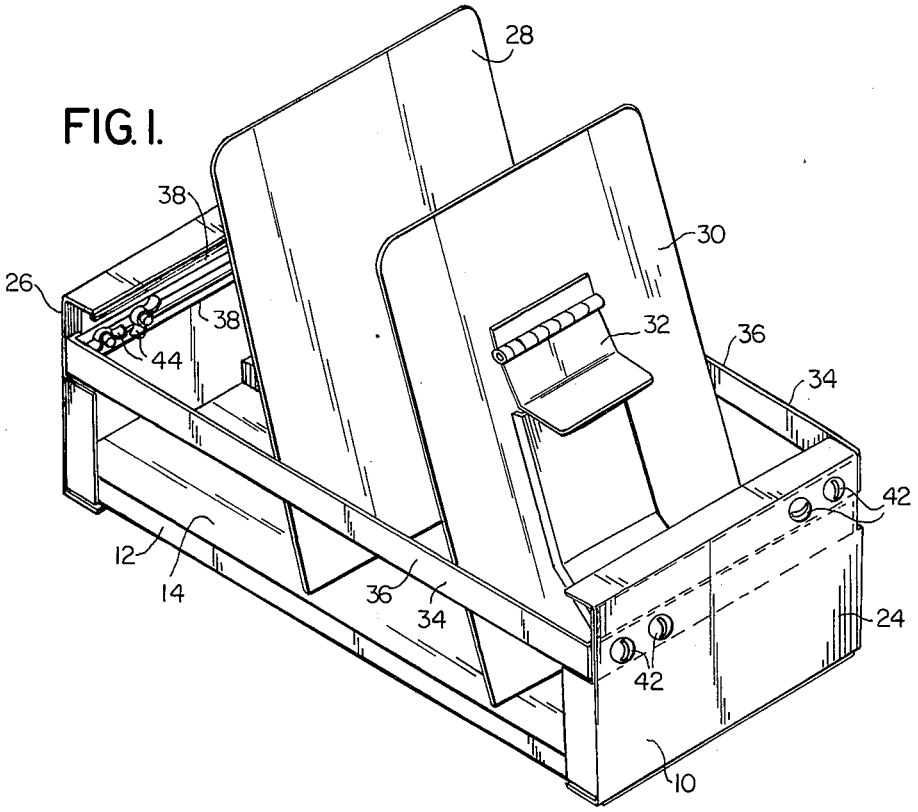
FIG. 1 is a perspective view of a posting tray embodying this invention, the side rail members in this view being shown in a position of minimum spacing.
Figure 2:
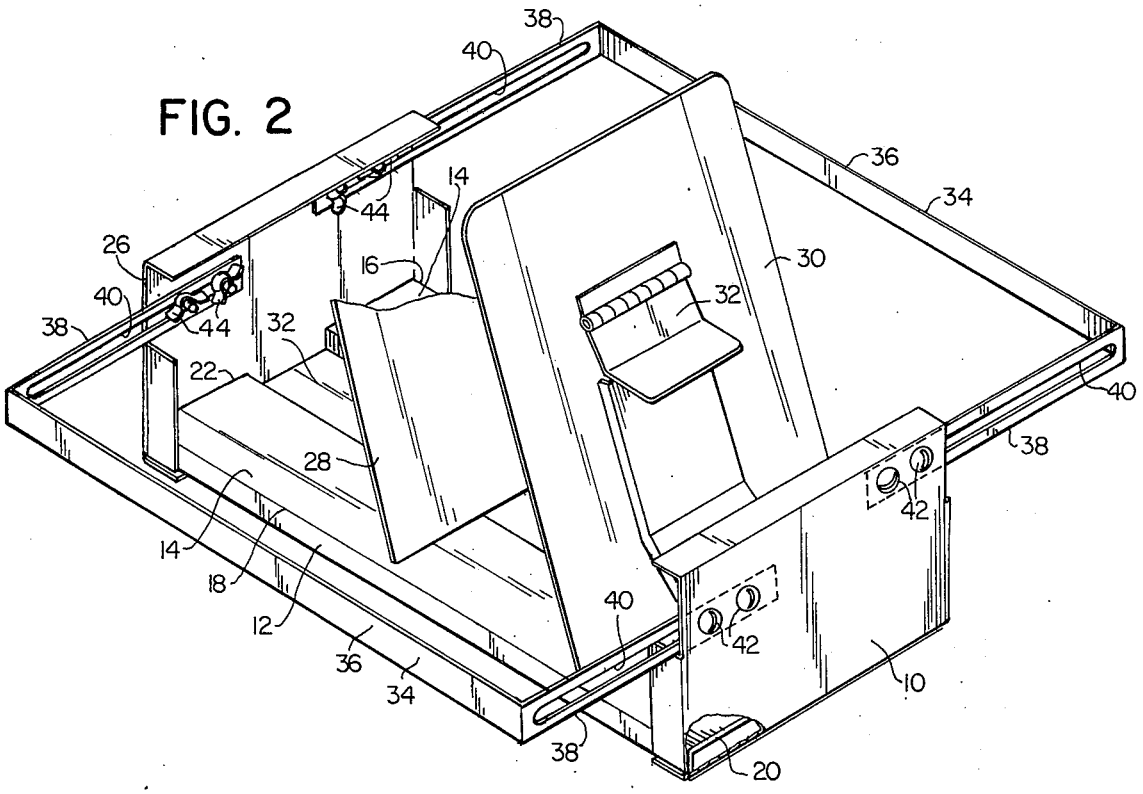
FIG. 2 is a view similar to FIG. 1 but with the side rail members being shown shifted to a position of maximum spacing and with a portion of the rear follower plate being broken away to reveal other details of the tray.

FIGS. 1 and 2 show a posting tray 10 comprising one embodiment of this invention. Referring to these figures, the tray 10 is made almost entirely of sheet metal parts and has a generally rectangular base 12 providing an upwardly facing support surface 14 for supporting the bottom edges of a collection of record cards placed thereon in a face-to-face relationship with their faces oriented generally vertically. The supporting surface 14 has a generally rectangular outline defined by a right side edge 16, a left side edge 18, a front end edge 20 and a rear end edge 22. A front wall member 24 is welded to the base 12 and extends upwardly from the front edge 20. A similar rear wall 26 is welded to the base and extends upwardly from the rear edge 22.

The tray also includes a rear follower plate 28 and a front compressor plate 30, both of which are of may be of conventional construction. The follower plate 28 is carried by a block, not shown, which rides in a central recess 32 of the base to allow forward and rearward adjustment of the follower block to vary the spacing between it and the compressor plate 30, and the block includes a catch mechanism for locking it in any one of numerous different positions of adjustment relative to the base. The compressor plate 30 is not adjustable forwardly and rearwardly relative to the base but includes a latch mechanism, indicated generally at 32, allowing it to be swung from the illustrated rearwardly inclined position to a forwardly inclined position.

Record cards to be held by the tray are placed between the follower plate 28 and the compressor plate 30. When the compressor plate 30 is in the illustrated rearwardly inclined position, it holds the record cards in a compressed state between it and the follower plate 28 to inhibit destruction of the records by burning in the event of a fire. The latch 32 releasably holds the compressor plate 30 in this position with a positive over-center action. When the compressor plate is moved to its released or forwardly inclined position, access can be had to any individual record card by inclining forwardly all of those cards located forwardly of the accessed card and by allowing the other cards to remain in their rearwardly inclined position.

The number of cards which the tray can hold is adjustable by adjusting the position of the follower plate 28; and, in addition to the parts already described, the tray also includes two side rail members 34, 34 which are also adjustable to suit the tray to different widths of record cards. Each side rail member 34 is of a C-shape and includes a side rail portion 36 and two legs 38, 38. The side rail portion of each rail member extends from the front wall to the rear wall of the tray and is adapted to engage the adjacent side edges of the record cards received in the tray. The two front legs 38, 38 of the two rail members overlap the inner surface of the front wall 24 and the two rear legs 38, 38 overlap the front surface of the rear wall 26. Each leg has an elongated slot 40 and is adjustably connected to its associated wall by two screws 42, 42. The screws are carried by the associated wall and have horizontal shanks which pass through the leg slot 40 and carry thumb nuts 44, 44 on their inner ends. Therefore, when the four thumb nuts 44, 44 associated with each rail member are loosened, the rail member may be adjusted laterally relative to the base 12 and walls 24 and 26, and when the nuts 44, 44 are tightened they will hold the rail member in the selected position of adjustment.

The length of the slots 40, 40 and the placement of the screws 42, 42 is such that as a condition of minimum spacing between the side rail portions 36, 36, the rail members are movable inwardly to at least the positions shown in FIG. 1 at which the rail portions 36, 36 are vertically aligned with the side edges 16 and 18 of the base. To allow for a wide change in the spacing between the side rail portions, the legs 38, 38 have a length which is equal to more than half the width of the end walls 24 and 26 and which is preferably substantially equal to such width. This means that when the rail members are in the condition of minimum spacing shown in FIG. 1 at least portions of the two legs associated with each end wall overlap one another. In the illustrated case of FIGS. 1 and 2 this overlapping is accommodated in the vertical plane by having one side rail member located at a level different from that of the other. That is, the left-hand rail member 34 is positioned lower than the right-hand one which vertically overlies it. This also has the advantage that when two trays are placed side by side, the side rail of one tray will overlie the neighboring side rail of the other tray thereby allowing the two trays to be fitted into a smaller space. In the illustrated case, the legs 38, 38 each are of a length substantially equal to the width of the front and rear walls 24 and 26 and the length of the slots 40, 40 and the placement of the screws 42, 42 are such that when the rail members are moved to their maximum positions shown in FIG. 2, the two legs adjacent each end wall are moved out of overlapping relationship with one another. Thus, the spacing between the two side rail portions 36, 36 in FIG. 2 is between two and three times greater than the spacing between the same portions when positioned as in FIG. 1.

FIGS. 3 to 6 show a tray 50 which is generally similar to the tray 10 of FIGS. 1 and 2, except that the overlapping of the legs of the rail members is accommodated in the horizontal plane rather than in the vertical plane. Parts of the tray 50 which are similar to corresponding parts of the tray 10 have, therefore, been given the same reference numerals as in FIGS. 1 and 2 and need not be redescribed.

Referring to FIGS. 3 to 6, in these figures the rail members are indicated at 52, 52, each having a side rail portion 54 and two inwardly extending legs 56, 56 at its opposite ends. The two rail members are at the same level relative to the supporting surface 14 and each leg 56 has a length approximately equal to the width of the front and rear walls 24 and 26. Therefore, throughout a portion of the range of movement of the rail members the two legs 56, 56 adjacent each end wall overlap one another, as shown best in FIG. 4.

As shown in FIG. 5, each wall member 24 and 26 includes a main vertical panel 58, a horizontal top strip 60 and a downwardly extending inner lip 62 defining a laterally extending open bottomed channel 64 in the upper portion of the wall member. Two vertical screws 66, 66 pass through the top strip 60 and have threaded shanks located in the channel 64. The two associated legs 56, 56 of the rail members are received in the channel 64 and are located on opposite sides of the screw shanks. Fitted into the open bottom of the channel 64 is an elongated U-shaped channel member 68 with a base 70 and two side arms 72, 72. The two legs 56, 56 are each located between the screws 66, 66 and a respective one of the side arms 72, 72, and they rest on the base 70. The base 70 further has two screws 74, 74 fixed thereto which threadably receive the lower ends of the screws 66, 66.

When all four screws are loosened the two side rail members 52, 52 may be slid relative to the base 12 and to the end walls 24 and 26 to vary the spacing between their side rail portions 54, 54. when the screws are thereafter tightened the base 70 of each channel member is drawn upwardly to clamp the associated two legs between it and the top strip 60 to securely lock the legs in the selected position of adjustment. Therefore, by loosening and tightening the screws and moving the side rail members, the two side rail portions may be easily and quickly set to accommodate a given width of record card to be used with the tray.

I claim:

1. A tray for holding a collection of generally rectangular record cards in face-to-face arrangement with their faces generally vertical, said tray comprising a base providing a generally rectangular horizontal support surface with front and rear ends, front and rear walls fixed to said base and extending upwardly from said front and rear ends thereof respectively, and two C-shaped side rail members separate from said base and said front and rear walls and located at opposite sides of said support surface, said two side rail members each having a vertical dimension substantially less than that of said front and rear walls and being spaced in its entirety above said support surface, each of said side rail members including an elongated side rail portion extending horizontally between said front and rear walls and each of said side rail members having two elongated legs at opposite ends of its side rail portion extending horizontally inwardly from said side rail portion into overlapping relationship with said front and rear walls respectively, and connecting means connecting the two of said legs overlapping said front wall to said front wall and the two said legs overlapping said rear wall to said rear wall for rectilinear slidable movement of said legs horizontally relative to said walls and laterally of said base to vary the spacing between said side rail portions, said connecting means including a plurality of threaded fasteners which may be tightened to releasably fix said legs relative to said walls and which may be loosened to free said legs for said rectilinear slidable movement, said legs of said C-shaped rail member being of such lengths and said connecting means being so constructed that throughout one portion of the range of movement of said rail members the two of said legs associated with each of said walls overlap one another and that throughout another portion of the range of movement of said rail members the two of said legs associated with each of said walls do not overlap one another.

2. A tray for holding a collection of generally rectangular record cards in face-to-face arrangement with their faces generally vertical, said tray comprising a base providing an upwardly facing horizontal support surface for engaging and supporting the lower edges of record cards placed in said tray, said support surface having front and rear ends and right and left side edges, a vertical front wall fixed relative to said base and extending upwardly from said front end of said support surface, a vertical rear wall fixed relative to said base and extending upwardly from said rear end of said supporting surface, right and left rail members separate from said base and said end walls and carried by said end walls, said rail members each having a vertical dimension substantially less than that of said front and rear walls, said right rail member including an elongated horizontal side rail portion extending longitudinally of said base between said front and rear walls and located generally adjacent to and vertically spaced above said right side edge of said support surface, said left rail member including an elongated horizontal side rail portion extending longitudinally of said base between said front and rear walls and located generally adjacent to and vertically spaced above said left side edge of said support surface, said right rail member having an elongated front leg and an elongated rear leg at opposite ends of its side rail portion extending horizontally leftwardly therefrom, said left side rail member having an elongated front leg and an elongated rear leg at opposite ends of its side rail portion extending horizontally rightwardly therefrom, at least part of each of said two front legs overlapping said front wall and at least part of each of said two rear legs overlapping said rear wall, and connecting means for connecting said two front legs to said front wall and said two rear legs to said rear wall for rectilinear slidable movement of said legs horizontally relative to said wall and laterally of said base to vary the spacing between said right and left side rail portions, said connecting means including a plurality of threaded fasteners which may be tightened to releasably fix said legs relative to said walls and which may be loosened to fix said legs for said rectilinear slidable movement, said four legs of said two rail members being of such lengths and said connecting means being so constructed that said two front legs overlap one another and said two rear legs overlap one another throughout one portion of the range of moement of said two rail members and so that said front legs do not overlap one another and said two rear legs do not overlap one another throughout another portion of the range of movement of said two said members.

3. A tray for holding a collection of generally rectangular record cards in face-to-face arrangement with their faces generally vertical, said tray comprising a base providing a generally rectangular horizontal support surface with front and rear ends, front and rear walls fixed to said base and extending upwardly from said front and rear ends thereof respectively, and two C-shaped side rail members located above opposite sides of said support surface, each of said side rail members including an elongated side rail portion extending between said front and rear walls and each of said side rail members having two legs at opposite ends of its side rail portion extending inwardly from said side rail portion into overlapping relationship with said front and rear walls respectively, and means connecting the two of said legs overlapping said front wall to said front wall and the two said legs overlapping said rear wall to said rear wall for slidable movement of said legs relative to said walls laterally of said base to vary the spacing between said side rail portions and for releasably fixing said legs relative to said walls in any selected position of adjustment, said legs of said C-shaped rail members being of such lengths that throughout a portion of the range of movement of said rail members the two of said legs associated with said front wall overlap one another and the two of said legs associated with said rear wall also overlap one another, said two side rail members being located at different vertical levels relative to said supporting surface so that when said legs overlap one leg of each overlapping pair of legs vertically overlies the other leg of the pair.

4. The tray as defined in claim 3 further characterized by each of said legs of said two side rails being slotted, and said connecting means comprising, for each leg, two laterally spaced horizontal screws carried by the adjacent one of said front and rear walls extending through the slot of the leg, and a nut threadably received on each of said screws for rotation between a tightened position at which said screw and nut hold the associated leg fixed to the associated wall and a loosened position at which the leg is free to slide relative to said screw.

5. A tray for holding a collection of generally rectangular record cards in face-to-face arrangement with their faces generally vertical, said tray comprising a base providing an upwardly facing horizontal support surface for engaging and supporting the lower edges of record cards placed in said tray, said supporting surface having front and rear ends and right and left side edges, a vertical front wall fixed relative to said base and extending upwardly from said front end of said support surface, a vertical rear wall fixed relative to said base and extending upwardly from said rear end of said supporting surface, right and left rail members carried by said end walls, said right rail member including a horizontal side rail portion extending longitudinally of said base between said front and rear walls and located generally adjacent to and vertically spaced above said right side edge of said support surface, said left rail member including a horizontal side rail portion extending longitudinally of said base between said front and rear walls and located generally adjacent to and vertically spaced above said left side edge of said support surface, said right rail member having a front leg and a rear leg at opposite ends of its side rail portion extending leftwardly therefrom, said left side rail member having a front leg and a rear leg at opposite ends of its side rail portion extending rightwardly therefrom, at least part of each of said two front legs overlapping said front wall and at least part of each of said two rear legs overlapping said rear wall, and connecting and fixing means for connecting said two front legs to said front wall and said two rear legs to said rear wall for slidable movement of said legs relative to said wall laterally of said base to vary the spacing between said right and left side rail portions and for releasably fixing said legs relative to said walls in any selected position of adjustment, said right and left side rail members being located at different vertical levels relative to said support surface whereby when two identical trays are placed side-by-side the two side rail portions of the two trays which are positioned adjacent to one another will vertically overlap one another.

* * * * *